US009485591B2

(12) United States Patent
Edgar et al.

(10) Patent No.: US 9,485,591 B2
(45) Date of Patent: Nov. 1, 2016

(54) MANAGING A HEARING ASSISTANCE DEVICE VIA LOW ENERGY DIGITAL COMMUNICATIONS

(71) Applicant: Starkey Laboratories, Inc., Eden Prairie, MN (US)

(72) Inventors: Daniel Mark Edgar, Lakeville, MN (US); Kirk Klobe, Eden Prairie, MN (US); Michael Helgeson, New Richmond, WI (US); Jeffrey Paul Solum, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/566,052

(22) Filed: Dec. 10, 2014

(65) Prior Publication Data

US 2016/0173996 A1 Jun. 16, 2016

(51) Int. Cl.
*H04R 25/00* (2006.01)

(52) U.S. Cl.
CPC ..... *H04R 25/50* (2013.01); *H04R 25/554* (2013.01); *H04R 2225/021* (2013.01); *H04R 2225/023* (2013.01); *H04R 2225/025* (2013.01)

(58) Field of Classification Search
CPC .... H04R 25/00; H04R 25/55; H04R 25/558; H04R 2225/49; H04R 2460/01
USPC ..... 381/312, 315–317, 320–321
See application file for complete search history.

(56) References Cited

U.S. PATENT DOCUMENTS 6,115,478 A * 9/2000 Schneider ..... H04R 25/558 381/312
6,741,712 B2 * 5/2004 Bisgaard ..... H04R 25/505 381/312

(Continued)

FOREIGN PATENT DOCUMENTS

EP 1727393 A1 11/2006
EP 2549397 A1 1/2013

(Continued)

OTHER PUBLICATIONS

"A beginner's guide to SNMP", [Online]. Retrieved from the Internet: <URL: http://www.snmplink.org/snmparticles/abeginnersguide/ >, (2015), 3 pgs.

(Continued)

*Primary Examiner* — Suhan Ni
(74) *Attorney, Agent, or Firm* — Schwegman Lundberg & Woessner, P.A.

(57) ABSTRACT

Disclosed herein, among other things, are systems and methods for programming and modifying hearing assistance devices via low energy digital communications. One aspect of the present subject matter includes a method of using a hearing assistance device. The method includes providing characteristics and descriptors of the hearing assistance device compatible with a low energy digital communication protocol, the characteristics and descriptors accessible to an external communication device. According to various embodiments, the method also includes accepting individual read/write cycles from an external communication device configured to use the low energy digital communication protocol to read and update the characteristics and descriptors using an abstraction layer. The hearing assistance device is configured to compensate for a wearer's hearing loss based on the updated characteristics and descriptors, in various embodiments.

22 Claims, 4 Drawing Sheets

(56) References Cited

U.S. PATENT DOCUMENTS

| | | | | |
|---|---|---|---|---|
| 7,779,153 | B2 * | 8/2010 | Van den Heuvel | A61N 1/36032 381/315 |
| 8,477,975 | B2 * | 7/2013 | Glatt | H04R 25/55 381/312 |
| 8,503,703 | B2 | 8/2013 | Eaton et al. | |
| 9,197,972 | B2 | 11/2015 | Tran et al. | |
| 2005/0249368 | A1 | 11/2005 | Menzl et al. | |
| 2006/0205349 | A1 | 9/2006 | Passier et al. | |
| 2011/0059769 | A1 | 3/2011 | Brunolli | |
| 2013/0329924 | A1 | 12/2013 | Fleizach et al. | |
| 2015/0010159 | A1 | 1/2015 | Tran | |

FOREIGN PATENT DOCUMENTS

| | | | |
|---|---|---|---|
| WO | WO-0057672 | A2 | 9/2000 |
| WO | WO-0235884 | A2 | 5/2002 |
| WO | WO-2006136616 | A2 | 12/2006 |
| WO | WO-2008071231 | A1 | 6/2008 |
| WO | WO-2014094859 | A1 | 6/2014 |

OTHER PUBLICATIONS

"U.S. Appl. No. 13/937,022, Non Final Office Action mailed Jan. 6, 2015", 8 pgs.

"Bluetooth: Technology Overview: Profiles Overview", [Online]. Retrieved from the Internet: <URL: http://developer.bluetooth.org/KnowledgeCenter/TechnologyOverview/Pages/Profiles.aspx>, (2011), 2 pgs.

"European Application Serial No. 14175915.9, Extended European Search Report mailed Nov. 5, 2014", 11 pgs.

"U.S. Appl. No. 13/937,022, Notice of Allowance mailed Jun. 23, 2015", 5 pgs.

"U.S. Appl. No. 13/937,022, Response filed Jun. 8, 2015 to Non Final Office Action mailed Jan. 6, 2015", 8 pgs.

U.S. Appl. No. 14/949,501, filed Nov. 23, 2015, Dynamic Negotiation and Discovery of Hearing Aid Features and Capabilities by Fitting Software to Provide Forward and Backward Compatibility.

"European Application Serial No. 15199410, Extended European Search Report mailed May 10, 2016", 7 pgs.

* cited by examiner

REQUEST: GET DEVICE CATEGORIES
RESPONSE: CHANNELS, MEMORIES, FEATURES

REQUEST: GET CATEGORY "CHANNELS" MEMBERS
RESPONSE: CHANNEL0, CHANNEL1, CHANNEL2...

REQUEST: GET MEMBER "CHANNEL0" PROPERTIES
RESPONSE: {GAINMIN, R}, {GAINMAX, R}, GAIN, RW},{CENTERFREQUENCY, R}

REQUEST: GET PROPERTY "GAIN" VALUE
RESPONSE: 4

MANAGING A HEARING ASSISTANCE DEVICE VIA LOW ENERGY DIGITAL COMMUNICATIONS

TECHNICAL FIELD

This document relates generally to hearing assistance systems and more particularly to representing a hearing assistance device using an abstract layer of services, characteristics, attributes and descriptors which can be interrogated and modified using low energy digital communications.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducer and electro-mechanical components which are connected via wires to the hearing aid circuitry.

Hearing assistance devices often need to be accessed remotely for fitting and programming of the devices. Data such as configuration parameters and telemetry information can be downloaded and/or uploaded to the hearing assistance devices for the purpose of programming, control and data logging. However, existing standards for wired and wireless programming of hearing assistance devices use a "mailbox" approach for downloading and uploading information. A disadvantage of the "mailbox" approach is that a request/response loop is set up via a mailbox to access all hearing assistance device firmware parameters. This puts the burden of hearing assistance device reading and writing on the software application.

Accordingly, there is a need in the art for improved systems and methods for remotely accessing hearing assistance devices.

SUMMARY

Disclosed herein, among other things, are systems and methods for programming and configuring hearing assistance devices via low energy digital communications. One aspect of the present subject matter includes a method of using a hearing assistance device. The method includes providing characteristics and descriptors of the hearing assistance device compatible with a low energy digital communication protocol, the characteristics and descriptors of which accessible to an external communication device. According to various embodiments, the method also includes accepting individual read/write cycles from an external communication device configured to use the low energy digital communication protocol to read and update the characteristics and descriptors.

One aspect of the present subject matter includes a hearing assistance system for a wearer including a hearing assistance device configured to provide characteristics and descriptors of the hearing assistance device compatible with a low energy digital communication protocol. According to various embodiments, the hearing assistance device is further configured to accept individual read/write cycles from an external communication device configured to use the low energy digital communication protocol to read and update the characteristics and descriptors using an abstraction layer. The hearing assistance device is configured to compensate for a wearer's hearing loss based on the updated characteristics and descriptors, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
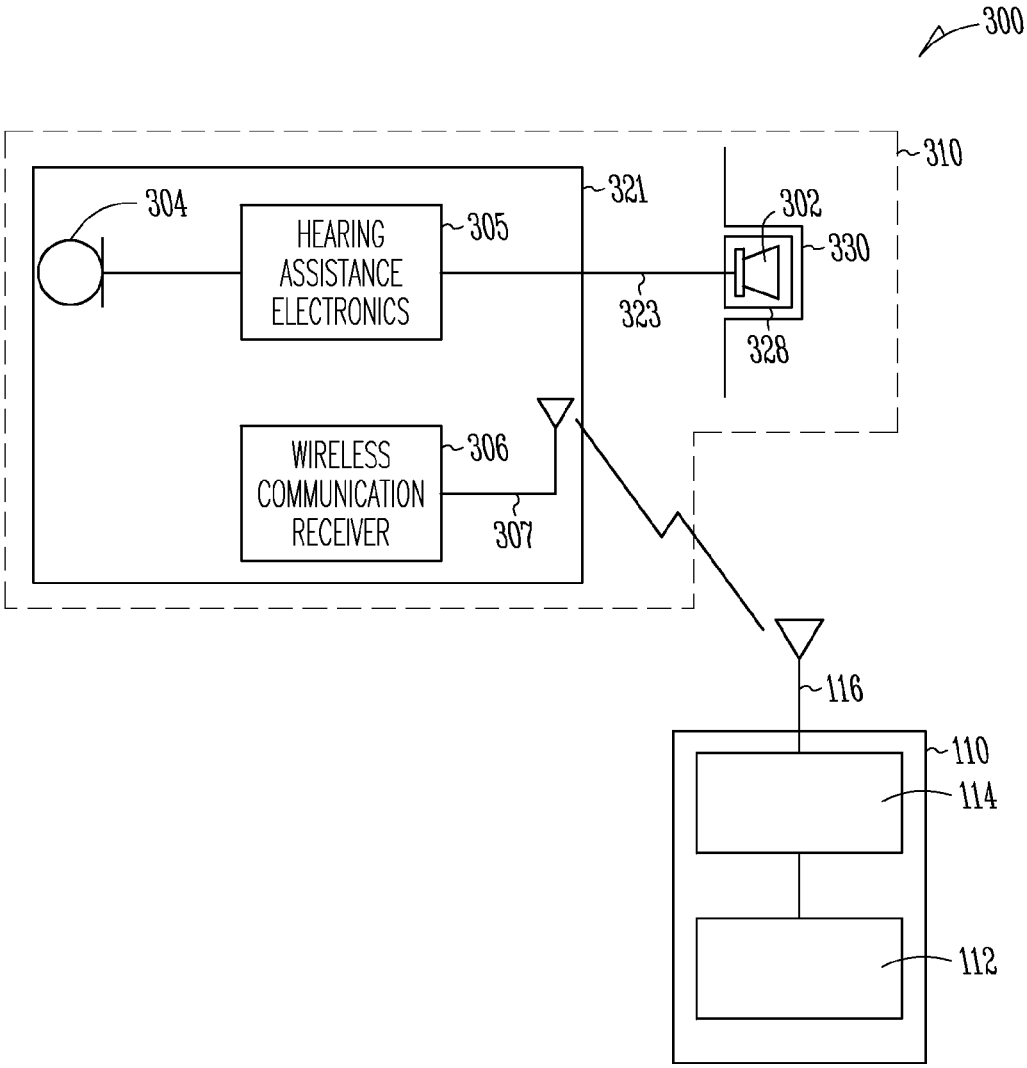
FIG. 1 illustrates a block diagram of a system including a hearing assistance device adapted to be worn by a wearer and an external Bluetooth host device, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing assistance devices often need to be accessed remotely for fitting and programming of the devices. Data such as configuration parameters and telemetry information can be downloaded and/or uploaded to the hearing assistance devices for the purpose of programming, control and data logging. However, existing standards for wired and wireless programming of hearing assistance devices use a "mailbox" approach for these purposes. A disadvantage of the "mailbox" approach is that a request/response loop is set up via a mailbox to access all hearing assistance device firmware parameters. This puts the burden of hearing assistance device reading and writing on the software application. This approach requires knowledge of memory-mapped information including program and data memory used within a hearing assistance device to modify the behavior of the device based on the needs of an individual patient.

Accordingly, there is a need in the art for improved systems and methods for remotely accessing hearing assistance devices.

Disclosed herein, among other things, are systems and methods for programming and modifying hearing assistance devices via low energy digital communications. One aspect of the present subject matter includes a method of using a hearing assistance device. The method includes providing characteristics and descriptors of the hearing assistance device compatible with a low energy digital communication protocol, the characteristics and descriptors accessible to an external communication device. According to various embodiments, the method also includes accepting individual read/write cycles from an external communication device configured to use the low energy digital communication protocol to read and update the characteristics and descriptors using an abstraction layer. The hearing assistance device is configured to compensate for a wearer's hearing loss based on the updated characteristics and descriptors, in various embodiments.

The present subject matter invention provides an alternate embodiment for exposing hearing aid functionality via low energy digital communications, including wired and wireless communication such as Bluetooth LE (low energy). No mailbox system is used for hearing aid communication, instead a tree of attributes and their characteristics and descriptors are created via the Bluetooth LE specification in various embodiments. According to various embodiments, the hearing aid firmware expresses the publicly available memory blocks, sensor output, and other functional areas using Bluetooth LE characteristics and descriptors.

A Bluetooth LE device implements a tree of characteristics and descriptors. Bluetooth LE devices then have individual read/write cycles on specific characteristics and descriptors. This tree of characteristics and descriptors allows a Bluetooth LE device to send or broadcast a structure of available attributes for reading and writing characteristics, sub-characteristics and descriptor data to a hearing aid. The Bluetooth LE specification relies on characteristics and descriptors because most Bluetooth LE devices are expected to be sensors in a sensor network and broadcast changes to characteristics and descriptors based on a device/battery friendly interval. Examples of low power devices include heart rate monitors, blood pressure sensors, etc.

Figure 3:
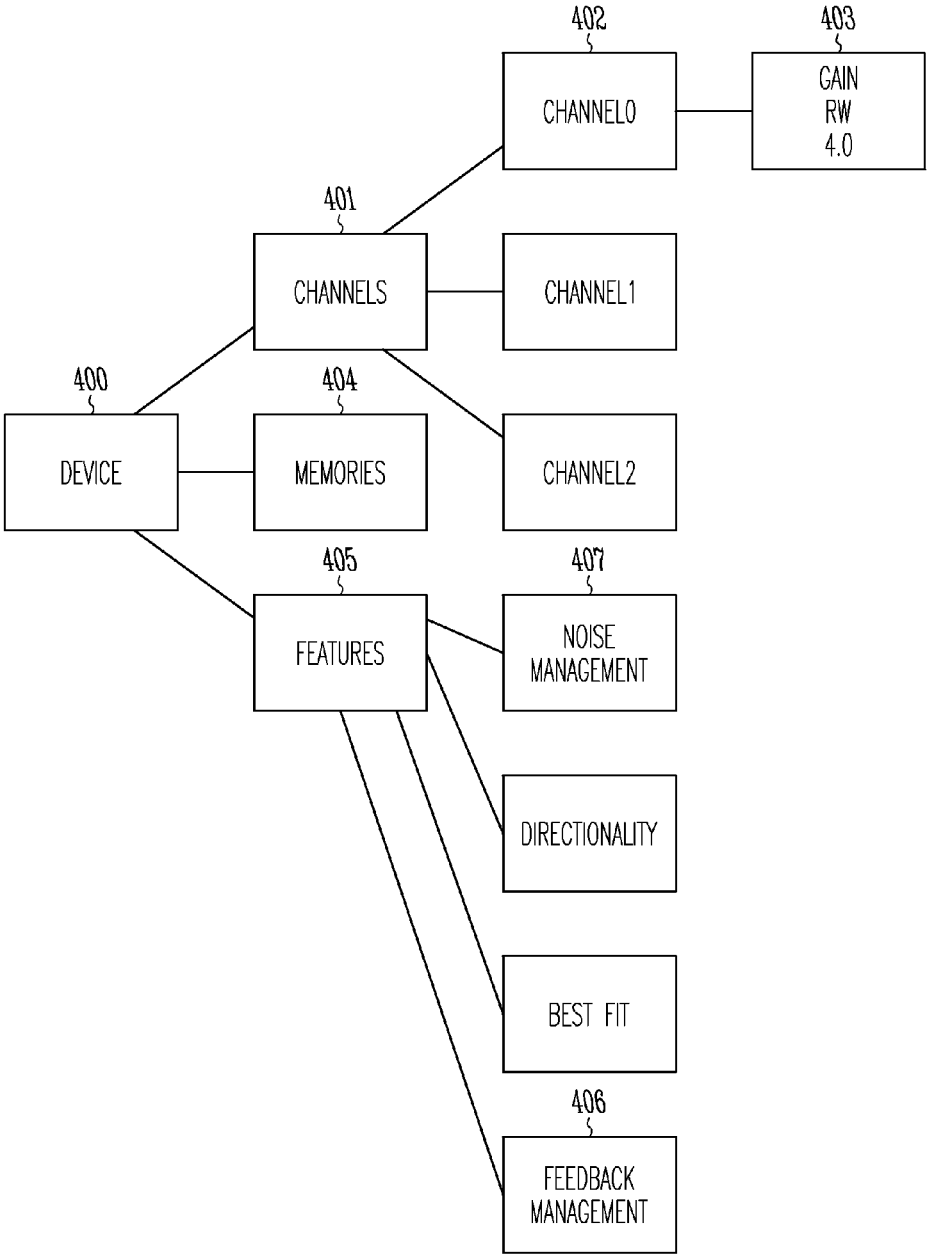
FIG. 3 illustrates an example of a hierarchical representation of a hearing assistance device, according to various embodiments of the present subject matter.

For hearing aids, characteristics and descriptors can be used to express audio characteristics and per-memory block information to an application, according to various embodiments of the present subject matter. Bluetooth LE characteristics and descriptors are a low level unit to allow reading and writing of data from a device. Thus, any device can express the data it wants to via a tree of characteristics and descriptors, an example of which is shown in FIG. 3. In a related field, this is similar to what is done to configure and program telecom network elements. In telecom networks, elements use SNMP (simple network management protocol) where the network element can be managed using its management information base (MIB) via an abstract view of those parameters that are configurable or important to the operation of the device being managed. The SNMP management device or the programmer or remote device such as a PC or IOS device can display the parameters that are exposed (those supported by the device's MIB) for programming without knowing anything about the device (such as a memory map information) once it connects to the device. The network management device or programmer can then understand and expose as much or as little of the manageable elements and notifications as programming allows in the application.

Figure 4:
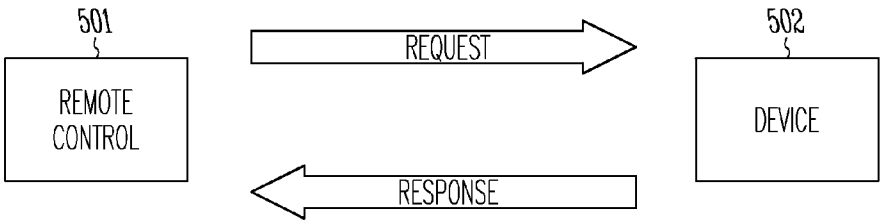
FIG. 4 illustrates a diagram of the communication between a host device or remote control and a hearing assistance device, according to various embodiments of the present subject matter.

In one example shown in FIG. 3, in a hearing aid parameters may include gain, gain thresholds, compression and compression thresholds on each frequency band or channel within the hearing aid. The hearing aid can be described as having N-bands or channels (a characteristic) and sub-characteristics such as gain, gain knee points, compression and compression thresholds. Using the present subject matter, attributes and their characteristics, sub-characteristics and descriptors, these parameters can be adjusted via an abstraction layer similar to an SNMP agent without the programmer knowing anything about how to make these adjustments, or without having to have intimate knowledge of the memory map of the hearing instrument. Using the present subject matter, it will no longer be necessary for the programmer to have an intimate knowledge of the memory map and algorithms that control the hearing instrument. It will also not be necessary to have a programming software release each time a new hearing aid is released. The programmer can simply walk through the hearing aids capabilities, or its MIB, by interrogating its services characteristics, attributes and descriptors using wired or wireless low energy digital communications, such as Bluetooth LE. Then they can be programmed using an abstraction layer or agent software resident on the target device rather than requiring direct memory access to all hearing aid parameters and coefficients. New characteristics, descriptors and attributes can be added to the hearing instrument prior to new programming software releases, in various embodiments. In one embodiment, any parameter the programming software does not understand can be left at default. Thus, new programming software can be released prior to having new hearing instruments that can employ knowledge of future planned characteristics. In one example, Bluetooth LE uses a similar concept in that it has a shared data base between the server (slave device) and the client (host device). As shown in FIG. 4, the host device can interrogate the services, attributes and characteristics of the slave device and program it accordingly. In this way it is possible to build a universal programmer for hearing instruments. For example, a programmer based on HTML code on a web browser or equivalent generic user interface may interact over the internet with the services, attributes and characteristics that determine the specific function of the hearing aid and which can be configured for a particular patients hearing loss.

According to various embodiments of the present subject matter, this method of hearing aid configuration will allow for faster and easier programming of hearing instruments since there is less information that needs to be exchanged and updated between the programmer and the aid. As shown in the examples below, these services that include characteristics, sub-characteristics, and attributes can be mapped into a Generic Attribute data base (GATT) as defined in Bluetooth Core 4.0 specification.

Hearing Aid From a Hierarchical Representation

Hearing aids can be represented by their features (services) and characteristics. An example of a hierarchical representation of a hearing instrument is shown in FIG. 3. A hearing device 400 has a channel service 401 MECO (Multichannel expansion and compression output). In this service the audio bandwidth is divided into channels. Each of these channels 402 has various attributes such as gains 403, gain thresholds and time constants. Other features 405 or services include feedback management 406, noise management 407, environmental adaptation, etc. Each of these has various characteristics and attributes, in an embodiment. A tree of services similar to the one shown in FIG. 3 can be generated each having various characteristics and attributes that can be modified as part of configuring a hearing instrument for a patients hearing loss, in an embodiment. FIG. 4 shows a diagram of the communication between a host device or remote control 501 and a hearing device 502 in which the remote device discovers by means of requests and responses the services, characteristics, and attributes of the hearing device, in various embodiments. Once collected, the remote control device or programmer 501 can interact with the functions of the hearing device 502 by modifying the characteristics and attributes of the hearing instrument 502, according to various embodiments.

Hearing Aid Sensor Data Example

Hearing aid firmware currently gathers and updates the sound input level at certain sound frequencies at a certain interval. In various embodiments of the present subject matter, these input levels can be expressed as a known and identifiable Bluetooth LE characteristic which can then be read by any Bluetooth LE remote supporting device 501. In addition, this single embodiment of a hearing aid expressing data via Bluetooth LE allows hearing aids to act as peers to a body area network of many Bluetooth LE devices, in an embodiment. The present subject matter provides the ability to express any data point that a hearing aid can sense (or has sensed) into a known published and standardized Bluetooth LE profile.

Hearing Aid Memory Map Example

Hearing aid firmware is currently broken down into memory blocks and parameters within memory blocks. In various embodiments of the present subject matter, the hearing aid firmware exposes the memory blocks and parameters as a tree of Bluetooth LE characteristics and descriptors. This gives any Bluetooth LE supporting device full random access to the entire memory footprint of the aid, all under hearing aid firmware control in various embodiments. Thus, the present subject matter is advantageous over the current "mailbox" method of reading and writing to a hearing aid. The "mailbox method" requires the client software to maintain a hardcoded address map of each hearing aid device and use the "mailbox" method to send instructions via a mailbox to the hearing aid firmware. In further embodiments, the timing, power consumption, and data structures from a hearing aid (i.e. per frequency sound input, data logging, live hearing aid feature status) can be made available as low energy attributes, characteristics and descriptors.

FIG. 1 illustrates a block diagram of a system 300, according to the present subject matter. The illustrated system 300 shows an external low energy digital communication device 110 (such as a Bluetooth low energy (LE) device) in wireless communication with a hearing assistance device 310. In various embodiments, the hearing assistance device 310 includes a first housing 321, an acoustic receiver or speaker 302, positioned in or about the ear canal 330 of a wearer and conductors 323 coupling the receiver 302 to the first housing 321 and the electronics enclosed therein. The electronics enclosed in the first housing 321 includes a microphone 304, hearing assistance electronics 305, a wireless communication receiver 306 and an antenna 307. In various embodiments, the hearing assistance electronics 305 includes at least one processor and memory components. The memory components store program instructions for the at least one processor. The program instructions include functions allowing the processor and other components to process audio received by the microphone 304 and transmit processed audio signals to the speaker 302. The speaker emits the processed audio signal as sound in the user's ear canal. In various embodiments, the hearing assistance electronics includes functionality to amplify, filter, limit, condition or a combination thereof, the sounds received using the microphone 304.

In the illustrated embodiment of FIG. 1, the wireless communications receiver 306 includes a Bluetooth LE receiver connected to the hearing assistance electronics 305 and the conductors 323 connect the hearing assistance electronics 305 and the speaker 302. In various embodiments, the external device 110 includes a Bluetooth LE host device. The external device 110 includes an antenna 116 connected to processing electronics 114 that include a transmitter, in an embodiment. In various embodiments, the external device 110 includes one or more components 112 connected to the processing electronics 114, such as memory components, sensing components or other types of electrical components.

Figure 2:
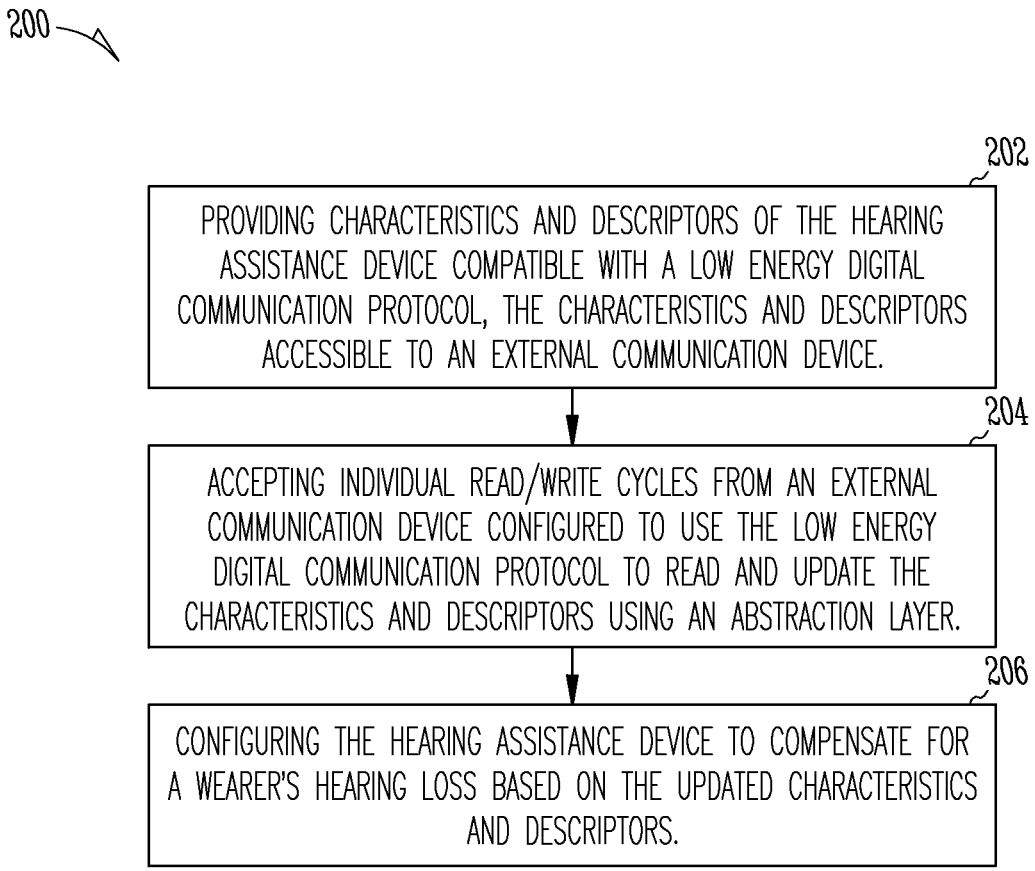
FIG. 2 illustrates a flow diagram of a method of using a Bluetooth transceiver, according to various embodiments of the present subject matter.

FIG. 2 illustrates a flow diagram of a method of using a Bluetooth transceiver, according to various embodiments of the present subject matter. The method 200 includes providing characteristics and descriptors of the hearing assistance device compatible with a low energy digital communication protocol, the characteristics and descriptors accessible to an external communication device, at 202. According to various embodiments, the method also includes accepting individual read/write cycles from an external communication device configured to use the low energy digital communication protocol to read and update the characteristics and descriptors using an abstraction layer, at 204. At 206, the method includes configuring the hearing assistance device to compensate for a wearer's hearing loss based on the updated characteristics and descriptors, according to various embodiments.

Various embodiments of the present subject matter supports both wired and wireless communications with a hearing assistance device. In various embodiments the wireless or wired communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method of using a hearing assistance device, the method comprising:

providing selected characteristics and descriptors of the hearing assistance device compatible with a low energy digital communication protocol, the selected characteristics and descriptors accessible to an external communication device;

accepting individual read/write cycles from an external communication device configured to use the low energy digital communication protocol to read and update the characteristics and descriptors using an abstraction layer; and configuring the hearing assistance device to compensate for a wearer's hearing loss based on the updated characteristics and descriptors.

2. The method of claim 1, wherein the communication protocol is wireless.

3. The method of claim 1, wherein the communication protocol is wired.

4. The method of claim 1, wherein the low energy digital communication protocol includes a Bluetooth Low Energy protocol.

5. The method of claim 1, wherein the external communication device includes a hearing assistance device programmer.

6. The method of claim 4, wherein the hearing assistance device includes a portion of a body area network of Bluetooth Low Energy devices.

7. The method of claim 1, wherein providing characteristics and descriptors includes exposing memory blocks and parameters of hearing aid firmware.

8. The method of claim 1, wherein providing characteristics and descriptors includes providing sound input level at a programmable frequency and a programmable interval.

9. The method of claim 1, wherein providing characteristics and descriptors includes providing a gain setting for the hearing assistance device.

10. The method of claim 1, wherein providing characteristics and descriptors includes providing a gain threshold for the hearing assistance device.

11. The method of claim 1, wherein providing characteristics and descriptors includes providing a compression setting for the hearing assistance device.

12. The method of claim 1, wherein providing characteristics and descriptors includes providing a compression threshold for the hearing assistance device.

13. A hearing assistance system for a wearer, comprising:

a hearing assistance device configured to make selected characteristics and descriptors of the hearing assistance device accessible to an external communication device, the selected characteristics and descriptors compatible with a low energy digital communication protocol, and further configured to accept individual read/write cycles from the external communication device configured to use the low energy digital communication protocol to read and update the characteristics and descriptors using an abstraction layer, wherein the hearing assistance device is configured to compensate for a wearer's hearing loss based on the updated characteristics and descriptors.

14. The system of claim 13, wherein the hearing assistance device includes a digital signal processor (DSP).

15. The system of claim 13, wherein the hearing assistance device includes a cochlear implant.

16. The system of claim 13, wherein the hearing assistance device includes a hearing aid.

17. The system of claim 16, wherein the hearing aid includes an in-the-ear (ITE) hearing aid.

18. The system of claim 16, wherein the hearing aid includes a behind-the-ear (BTE) hearing aid.

19. The system of claim 16, wherein the hearing aid includes an in-the-canal (ITC) hearing aid.

20. The system of claim 16, wherein the hearing aid includes a receiver-in-canal (RIC) hearing aid.

21. The system of claim 16, wherein the hearing aid includes a completely-in-the-canal (CIC) hearing aid.

22. The system of claim 16, wherein the hearing aid includes a receiver-in-the-ear (RITE) hearing aid.

* * * * *